US006053706A

United States Patent [19]

Allen

[11] Patent Number: 6,053,706

[45] Date of Patent: Apr. 25, 2000

[54] OIL PUMP WITH INTEGRATED OIL METERING DEVICE

[75] Inventor: David J. Allen, Gladstone, Mich.

[73] Assignee: Engineered Machined Products, Escanaba, Mich.

[21] Appl. No.: 09/042,261

[22] Filed: Mar. 13, 1998

[51] Int. Cl.[7] ..... F04R 23/12

[52] U.S. Cl. ..... 417/206

[58] Field of Search ..... 417/199.1, 206, 417/383, 395; 418/3, 61.3

[56] References Cited

U.S. PATENT DOCUMENTS 3,273,502 9/1966 Martz ..... 418/3
4,421,078 12/1983 Hurner .
4,495,909 1/1985 Hurner .

*Primary Examiner*—Timothy S. Thorpe
*Assistant Examiner*—Steven K. Brown
*Attorney, Agent, or Firm*—Brooks & Kushman P.C.

[57] ABSTRACT

An oil pump for use in a vehicle engine includes a rotary pump for pressurizing oil to be pumped, and a movable piston cooperating with the rotary pump to facilitate metering of oil to and from the pump. The oil metering device is incorporated directly into the pump by means of a cam-actuated piston or a spring-loaded piston which cooperates with a displacement chamber for metering oil. Alternatively, a solenoid-actuated piston may be provided for selectively blocking pressurized fluid from entering a spring-loaded diaphragm chamber. The diaphragm is stroked alternatively by a spring and by oil pressure for metering of fluid therethrough in desired increments.

3 Claims, 3 Drawing Sheets

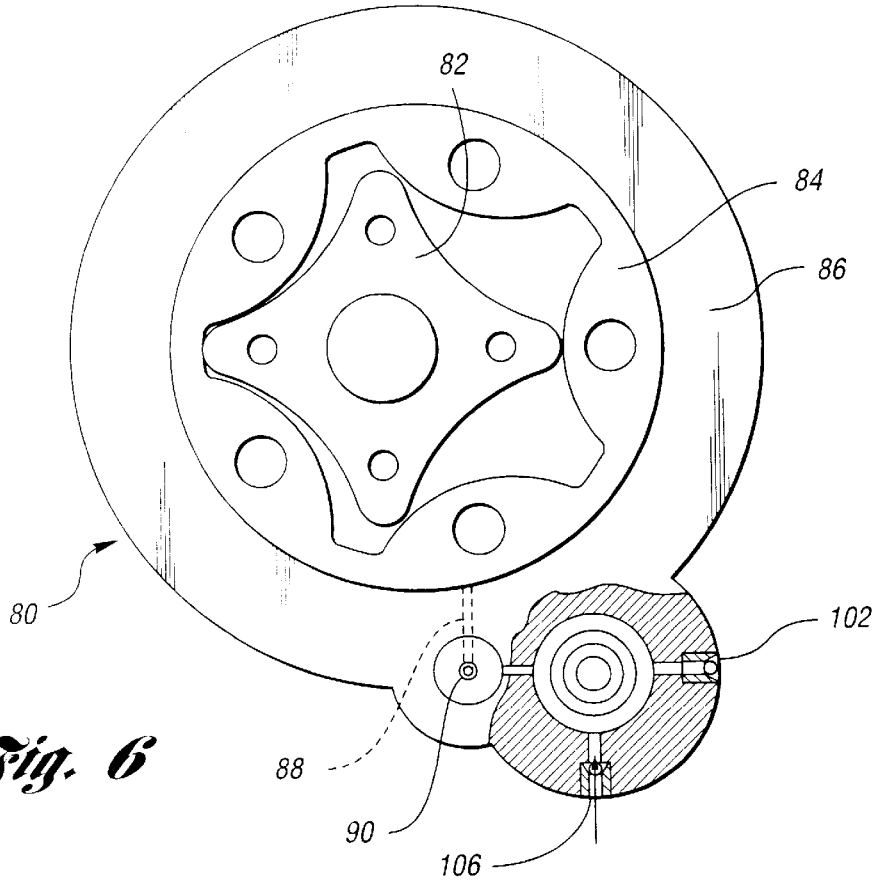
Fig. 6
Fig. 7
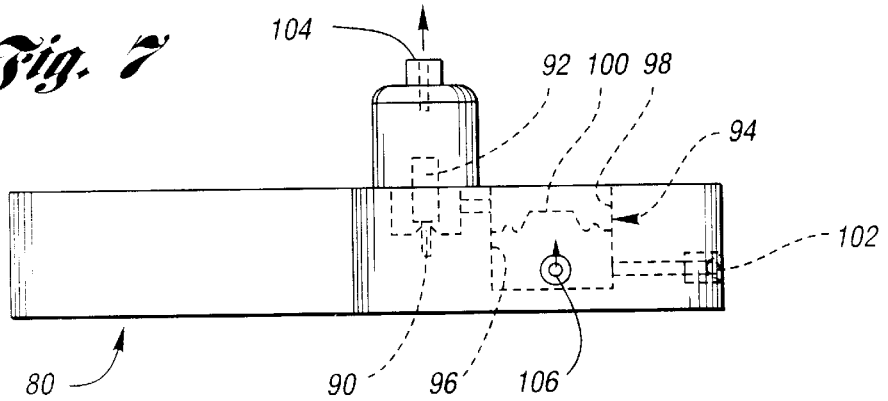
Fig. 8
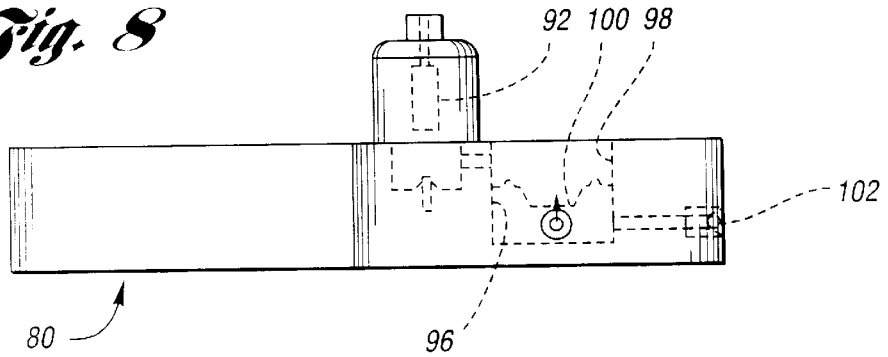

OIL PUMP WITH INTEGRATED OIL METERING DEVICE

TECHNICAL FIELD

The present invention relates to an oil pump with an integrated oil metering device for use in oil recovery, filtration, burn, makeup, lubrication, etc.

BACKGROUND OF THE INVENTION

In vehicle engines, it is sometimes desirable to meter incremental amounts of oil from the engine for oil recovery, filtration of dirty oil, burn off of dirty oil, oil makeup, specialized lubrication, etc. Such oil management systems require metering devices which are separate from the oil pump, which results in increased costs, increased weight, and increased packaging space requirements. Such an oil management metering device would typically require a pump or other pressure source, a pulley or pump motor for driving the pump, various hydraulic lines and valves, as well as sufficient packaging space within the engine compartment for storage.

One example of such a system is U.S. Pat. No. 4,495,909, which requires two solenoids, a hydraulic cylinder and a source of pressurized air, as well as numerous valves and ports, to accomplish the oil removal. Similarly, U.S. Pat. No. 4,421,078 requires three solenoid valves, a source of pressurized air, an air/oil cylinder, a piston and various vents, fittings and ports for oil removal.

Accordingly, it is desirable to provide an improved oil management metering device which does not require an additional pump or motor and which uses minimal engine compartment space.

DISCLOSURE OF THE INVENTION

The present invention overcomes the above-referenced shortcomings of prior art oil management metering devices by providing an oil pump with an oil metering device integrated therein. In this manner, the pressure generated by the pump or the mechanical movement of the pump is used to actuate the oil metering function, thereby eliminating the need for additional equipment for oil removal.

More specifically, the present invention provides an oil pump for use in a vehicle engine, including a rotary pump for pressurizing oil to be pumped, and a movable piston cooperating with the rotary pump to facilitate metering of oil from the pump.

In a preferred embodiment, the rotary pump comprises a stationary component and a rotatable component. One of the stationary and rotatable components includes a slanted groove formed therein for receiving the piston, whereby the piston is stroked to meter oil from the oil pump as the rotatable component is rotated. The slanted groove is operative as a cam for stroking the piston as the rotatable component is rotated. The stationary component includes a channel formed therein for receiving the movable piston. The channel includes an inlet check valve and an outlet check valve for allowing oil to enter and exit the channel as the piston is stroked.

In an alternative embodiment, the rotatable component includes a slot formed therein for slidably receiving the piston (or vane), and the stationary component and rotary component form a displacement chamber therebetween such that the piston moves through the displacement chamber to meter oil from the oil pump each time the rotatable component rotates. The stationary component includes an oil inlet channel and an oil outlet channel formed therein in fluid communication with the displacement chamber for delivering and receiving oil from the displacement chamber. The piston is movable radially with respect to the rotatable component.

In another alternative embodiment, the rotary pump includes an orifice therein for selectively receiving the pressurized oil. The movable piston is solenoid-operated, and movable for selectively blocking the orifice. The oil pump also includes a metering chamber having first and second chamber portions separated by a diaphragm. The first chamber portion is selectively communicated with the orifice when the piston is moved away from the orifice. The second chamber portion includes an inlet and outlet for metering oil therefrom as the piston is stroked by pressurized oil received through the orifice.

The movable piston which is positioned at least partially within the pump housing may be used to meter oil directly from the pump, or to meter oil from an oil source which is external to the pump.

Accordingly, an object of the present invention is to provide an oil metering device which does not require an additional pump, motor, or pulley for actuating the oil metering function.

Another object of the present invention is to provide an oil metering device which is integrated into an oil pump.

The above objects and other objects, features, and advantages of the present invention are readily apparent from the following detailed description of the best modes for carrying out the invention when taken in connection with the accompanying drawings.

BRIEF DESCRIPTION OF THE DRAWINGS

FIG. 6 shows a partially cut-away plan view of an oil pump with an integrated oil metering device in accordance with a second alternative embodiment of the invention;

FIG. 7 shows a side view of the oil pump of FIG. 6 during a dirty oil pumping stroke; and FIG. 8 shows a side view of the oil pump of FIG. 6 during a clean (or recovered) oil pumping stroke.

DETAILED DESCRIPTION OF THE PREFERRED EMBODIMENTS

Figure 1:
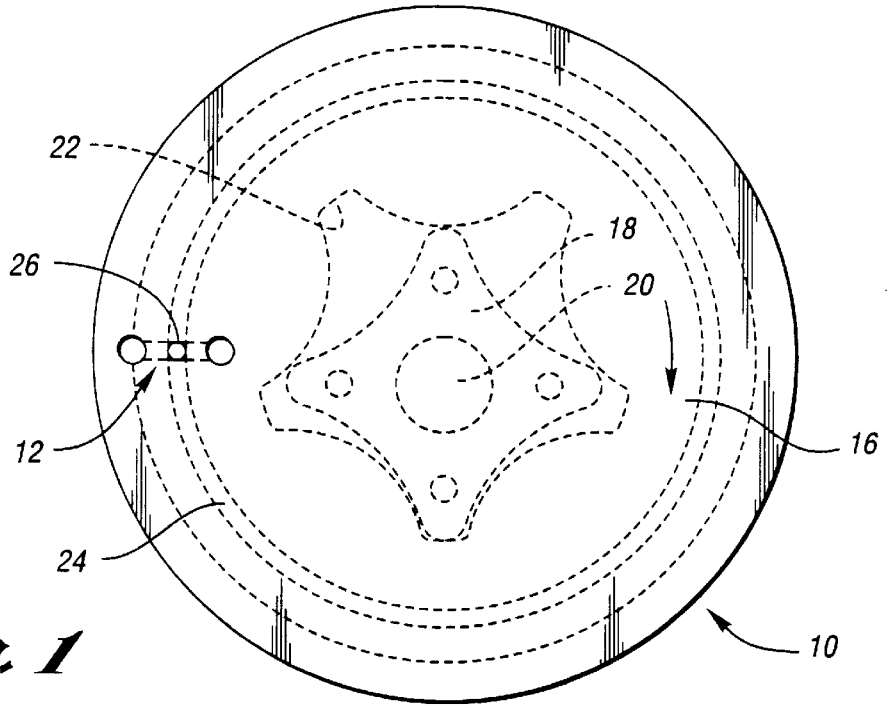
FIG. 1 shows a plan view of an oil pump incorporating an oil metering device in accordance with a preferred embodiment of the invention.
Figure 2:
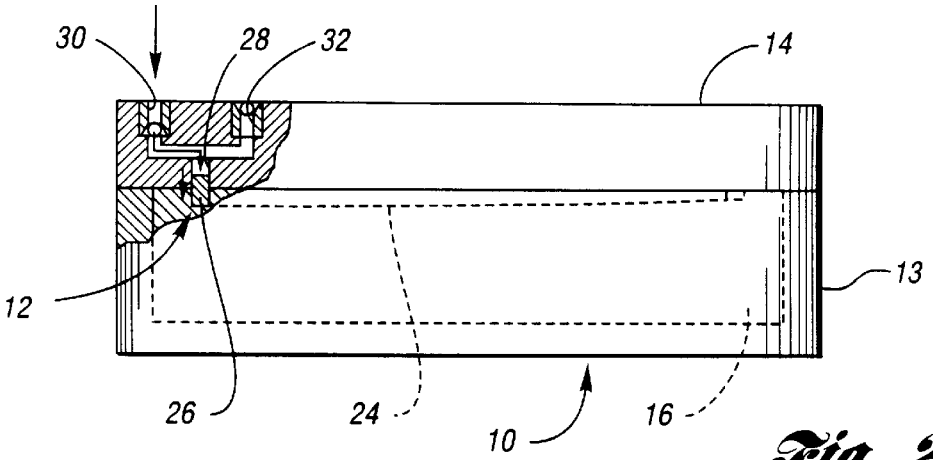
FIG. 2 shows a partially cut-away side view of the oil pump of FIG. 1 with the piston in the retracted position.
Figure 3:
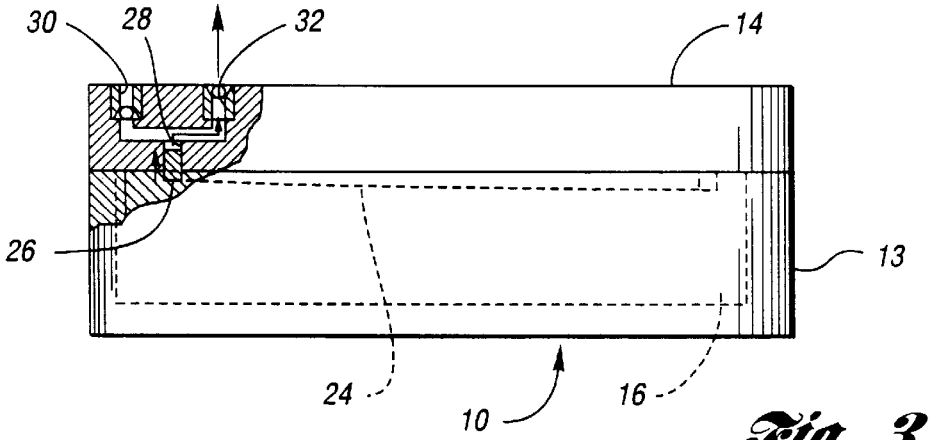
FIG. 3 shows a partially cut-away side view of the oil pump of FIG. 1 with the piston in the extended position.

Referring to FIGS. 1–3, a preferred embodiment of an oil pump 10 is shown integrating an oil metering device 12 in accordance with the present invention. The oil pump 10 is a G-rotor pump having a stationary cover 14 (or "pump housing"), an outside rotor 16, an inside rotor 18, and a stationary pump body 13 (also part of the pump housing).

The inside rotor 18 rotates about its axis 20, within the body 13, and moves around the star-shaped opening 22 to compress oil therein for pumping oil to the vehicle engine.

As shown, the outside rotor 16 includes a slanted annular groove 24 formed therein for receiving a piston 26. The piston 26 is preferably spring-loaded (not shown) such that rotation of the outside rotor 16 with respect to the stationary cover 14 causes the piston to follow along the annular slanted groove 24 to stroke up and down between the positions shown in FIGS. 2 and 3. Accordingly, the annular slanted groove 14 is operative as a cam surface for driving the piston 26 as the outside rotor 26 rotates.

The stationary cover 14 includes a channel 28 formed therein for receiving the movable piston 26. The channel 28 is provided in communication with an inlet check valve 30 and an outlet check valve 32 for allowing oil to enter and exit the channel as the piston 26 is stroked.

Accordingly, as the outside rotor 16 makes a full rotation, the piston 26 moves upward to the position shown in FIG. 3 in a pressure stroke to pressurize fluid in the channel 28 for forcing fluid through the outlet check valve 32 in order to meter fluid out of the pump 10 during each pump rotation. As the outside rotor 16 continues to rotate, the piston 26 then returns to the down position shown in FIG. 2. During this draw stroke, oil is drawn in through the inlet check valve 30 into the channel 28. Therefore, as the piston 26 moves up and down, the piston 26 draws oil in through check valve 30 and displaces the oil out of check valve 32 in a metered fashion. With each rotation of the pump, the volume of metered oil is determined by piston size, angle of the groove 24, and RPM of the pump 10. Alternatively, several pistons could be used to handle dirty oil separate from clean or recovered oil. A modification of this concept could include an electromagnetic device to retract the piston for more controllable metering, independent of rpm.

Figure 4:
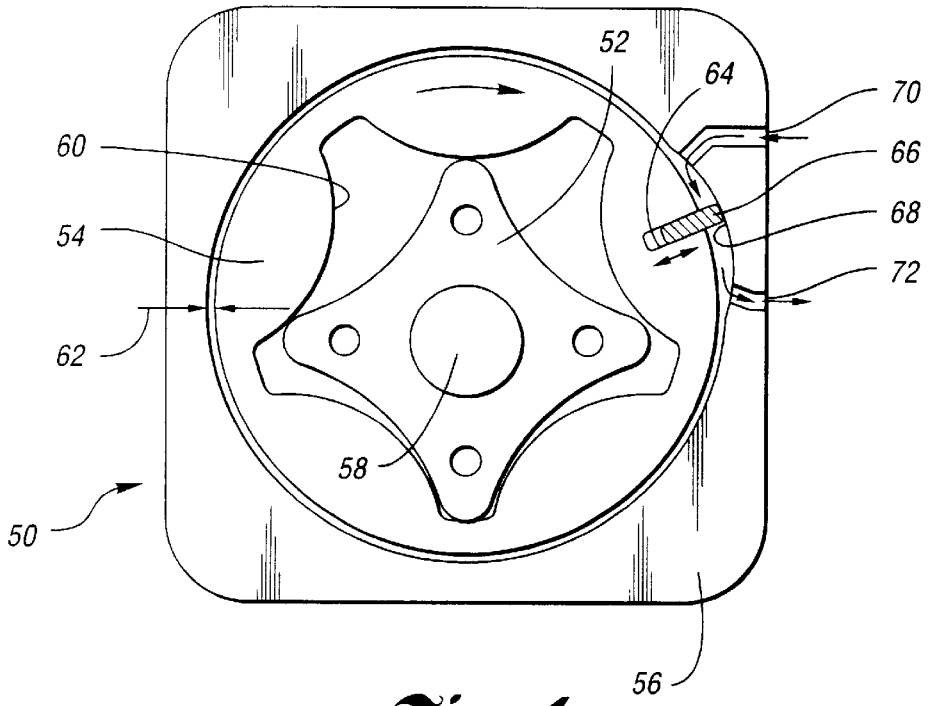
FIG. 4 shows a plan view of an oil pump with an integrated oil metering device in accordance with an alternative embodiment of the invention.
Figure 5:
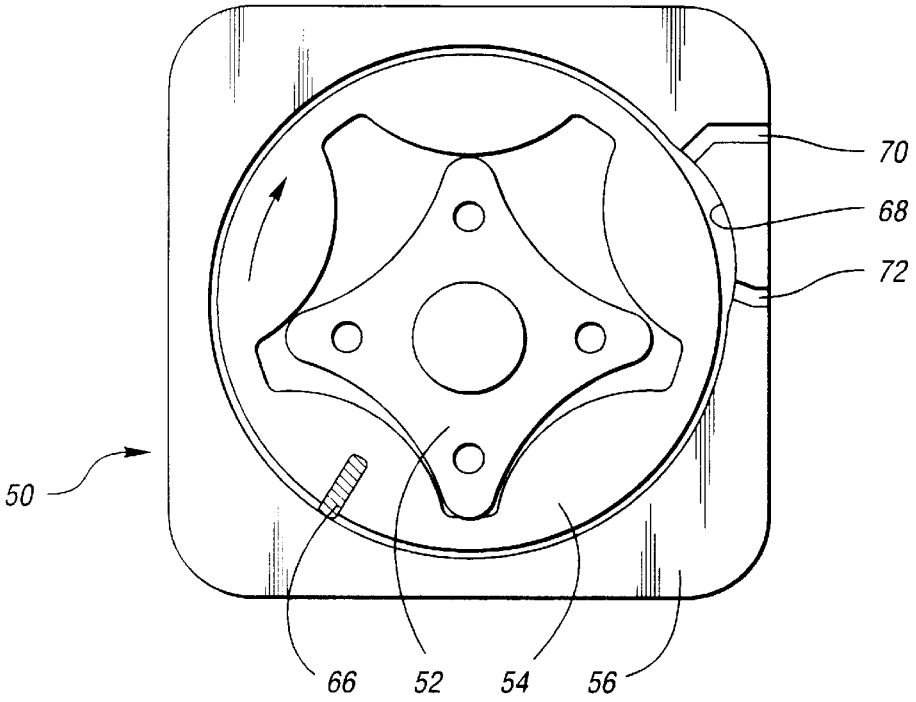
FIG. 5 shows a plan view of the oil pump of FIG. 4 with the pump in the non-metering position.

Turning to FIGS. 4 and 5, a pump 50 is shown in accordance with an alternative embodiment of the invention. Again, the pump 50 is a G-rotor pump having an inner rotor 52 and an outer rotor 54. A stationary housing 56 is provided outside the outer rotor 54. The inner rotor 52 rotates on its axis 58, and moves around the star-shaped opening 60 in the outer rotor 54 in order to pump (or displace) fluid within the opening 60.

Preferably, a gap 62 of less than 0.001 inch is formed between the stationary housing 56 and the outer rotor 54.

As shown, the outer rotor 54 has a slot 64 formed therein for slidably receiving the piston (or vane) 66, which is movable radially along the slot 64. The piston 66 is preferably spring-loaded radially outward such that it is caused to sweep through the displacement chamber 68, which is formed between the outer rotor 54 and the housing 56. As the piston 66 sweeps through the displacement chamber 68, it draws oil into the displacement chamber 68 through the inlet 70, while forcing oil out of the displacement chamber 68 through the oil outlet 72. Preferably, a check valve is provided at the inlet and outlet 70,72. Accordingly, each time the rotor 54 rotates, the piston 66 is caused to sweep through the displacement chamber 68, thereby metering oil from the pump 50. When the piston 66 is not in the displacement chamber, it is not pumping oil. With each rotation of the pump, a set amount of oil is metered whose volume is determined by the displacement chamber geometry and pump RPM.

A modification of this concept could be to electromagnetically retract the piston for more controllable metering, independent of RPM. Also, several chambers could be used for different oil types, such as dirty and clean.

Finally, turning to FIGS. 6–8, a second alternative embodiment of the invention is shown. The pump 80 is a G-rotor pump (or can be other types of conventional pumps) with inner and outer rotors 82,84 rotatable within a fixed housing 86. The housing 86 includes an oil line 88 which receives pressurized oil from the rotors 82,84. An orifice 90 is provided at the end of the oil line 88. As shown in FIGS. 7 and 8, a solenoid-actuated piston 92 is provided directly adjacent the orifice 90 for selectively blocking the orifice 90.

The housing 86 also includes a metering chamber 94 having first and second chamber portions 96,98, which are separated by diaphragm (or piston) 100. The first chamber portion 98 is in fluid communication with the orifice 90 when the solenoid-actuated piston 92 is in the up position, as shown in FIG. 8. Accordingly, in this position, dirty oil enters the second chamber portion 98, and forces the diaphragm 100 downward against a spring-load (not shown) as a result of the oil pressure, thereby compressing clean (or recovered) oil in the first chamber portion 96 and forcing the clean oil out the outlet check valve 102 for metering.

In the return stroke shown in FIG. 7, the piston 92 is moved into a position in which it blocks the orifice 90. During this stroke, the spring-load (not shown) against the diaphragm 100 forces the diaphragm 100 upward to compress the dirty oil in the second chamber portion 98, thus forcing the dirty oil through the outlet check valve 102. In this same stroke, as the diaphragm 100 moves upward as oriented in FIG. 7, such diaphragm movement causes clean oil to be drawn into the first chamber portion 96 through the inlet check valve 106.

Accordingly, in one stroke, high pressure dirty oil enters the second chamber portion 98, thereby forcing the diaphragm 100 down against the spring-load. In this down stroke, the diaphragm 100 forces clean oil out the check valve 102. When the solenoid-actuated piston 92 is cycled, a spring under the diaphragm 100 forces the diaphragm upward, sending the dirty oil out the check valve 104. During this upward stroke, clean oil is drawn into the first chamber portion 96 of the metering chamber 94 through the inlet check valve 106. The metering volume is determined by the diaphragm size and stroke, and is computer controlled with activation of the solenoid-actuated piston 92.

While the best modes for carrying out the invention have been described in detail, those familiar with the art to which this invention relates will recognize various alternative designs and embodiments for practicing the invention within the scope of the appended claims. This could include integrating oil metering into other types of oil pumps such as gear, vane, crescent, piston, etc.

What is claimed is:

1. An oil pump for use in a vehicle engine, comprising:

a rotary pump for pressurizing oil to be pumped to the engine, said rotary pump including a pump housing; and a movable piston positioned at least partially within the pump housing and cooperating with said rotary pump to facilitate metering of oil;

wherein said rotary pump comprises an orifice therein for selectively receiving said pressurized oil, said movable piston comprises a solenoid-operated piston movable for selectively blocking said orifice, and the oil pump further comprises a metering chamber having first and second chamber portions separated by a diaphragm, said first chamber portion being selectively communicated with said orifice when the piston is moved away from the orifice, and said second chamber portion including an inlet and outlet for metering oil therefrom as the piston is stroked.

2. The oil pump of claim 1, wherein said diaphragm is spring-loaded.

3. The oil pump of claim 1, wherein said rotary pump comprises a G-rotor pump.

* * * * *